United States Patent [19]

Webb

[11] Patent Number: 4,458,368

[45] Date of Patent: Jul. 10, 1984

[54] PLUNGER WITH ANTI-SPLASH SHIELD

[76] Inventor: Wallace M. Webb, 142 N. Weston Ave., Elgin, Ill. 60120

[21] Appl. No.: 432,414

[22] Filed: Oct. 4, 1982

[51] Int. Cl.[3] ..... E03D 9/00

[52] U.S. Cl. ..... 4/257; 4/300.3; 4/661

[58] Field of Search ..... 4/253, 255, 256, 257, 4/300.3, 481, 484, 485, DIG. 5, DIG. 18, 661; 134/154, 182, 183; 15/246, 248 R; D32/33

[56] References Cited

U.S. PATENT DOCUMENTS

| | | | |
|---|---|---|---|
| 2,529,587 | 11/1950 | Bates et al. | 4/257 |
| 2,844,826 | 7/1958 | Cheiten | 4/257 |
| 3,083,919 | 4/1963 | Farner | 100/902 |
| 3,193,845 | 7/1965 | Funk | 4/300.3 |
| 3,208,092 | 9/1965 | O'Leary | 4/253 |
| 3,491,379 | 1/1970 | Parrish | 4/661 |
| 4,060,859 | 12/1977 | Anderson | 4/307 |
| 4,133,062 | 1/1979 | Fullbright | 4/301 |

*Primary Examiner*—Stephen Marcus
*Assistant Examiner*—K. Putnam
*Attorney, Agent, or Firm*—McDougall, Hersh & Scott

[57] ABSTRACT

A device for clearing obstructed soil pipes without splashing water from a sink or toilet bowl comprises an elongate handle having a plunger member at a lower end and an anti-splash shield having a central passage to receive the elongate handle. The shield has a curvilinear circumference and includes an expandable resilient means at the outer edge thereof for transforming the shield from a folded condition to an expanded condition. Thus, the outer edge of the shield can sealingly engage the inner surface of the sink or toilet bowl to prevent water from splashing as the plunge is operated.

4 Claims, 4 Drawing Figures

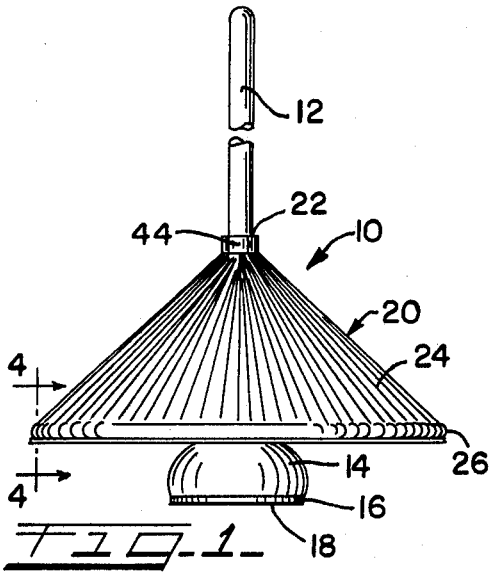
FIG. 1
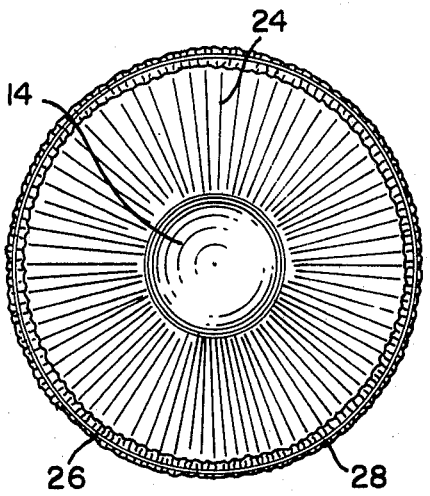
FIG. 2
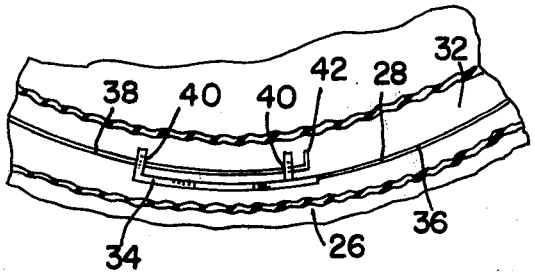
FIG. 4
FIG. 3
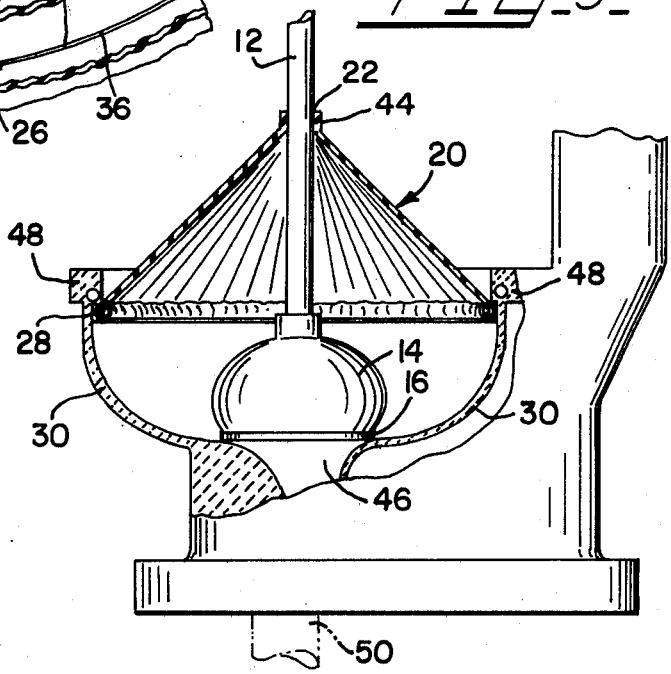

PLUNGER WITH ANTI-SPLASH SHIELD

BACKGROUND OF THE INVENTION

The present invention relates in general to a device for clearing obstructed soil pipes and, in particular, to a plunger having means for preventing water from splashing from a sink or toilet bowl when the plunger is operated.

It has been estimated that the flush cycle of a toilet should be completed within ten seconds. One cause of sluggish flushing is a blockage at some point in the soil pipe or in the baffle or the bowl. As used herein a "soil pipe" is a conduit that carries liquid waste; and a "baffle" is a partition that is usually included in the outlet passage of a toilet to form a trap which maintains water within the bowl before and after flushing. If a small object becomes jammed across one of the baffle surfaces, flow will be restricted and flushing of the toilet will be unreliable.

Obstructions other than roots growing through a soil pipe can usually be cleared by chemicals or by a manually operated plunger. There are several versions of plungers, but the operation of each type is similar. A plunger member is placed below the water surface, compressed over the drain area and pulled up sharply to create a vacuum. The resulting displacement in the drain usually frees the obstruction. Vigorous plunging action can splash water from the toilet onto the floor. The present invention is directed to the solution of this problem.

DESCRIPTION OF THE PRIOR ART

The prior art includes several references that disclose devices for clearing obstructed pipes or means for preventing splashing when a toilet is used or flushed. In accordance with the provisions of 37 CFR 1.97 et. seq., applicant states that the following references constitute the closest prior art of which he is aware.

U.S. Pat. No. 2,529,587 to Bates et al. relates to a device that includes sealing means for preventing the overflow of a blocked toilet. The device comprises a cover plate and gasket that sealingly engage the upper rim of a toilet bowl whereby the air trapped within the bowl is compressed when the toilet is flushed to augment the flushing action of the water. Thus, operation of the device depends solely on water pressure to clear the obstruction.

U.S. Pat. No. 4,060,859 to Anderson discloses a foldable anti-splash guard which can be removably secured to the upper rim of a toilet bowl to prevent splashing outwardly from the toilet bowl. Similarly, U.S. Pat. No. 4,133,062 to Fulbright describes a collapsible splash shield that extends between the toilet bowl and the seat to convert the toilet into a urinal.

Although unrelated to the art of plumbing, U.S. Pat. No. 3,083,919 to Farner does disclose a plunger extending through a lid or shield for reciprocating movement. Specifically, the Farner device can be secured to a garbage container to break bottles within the container thereby reducing the danger of flying glass.

SUMMARY OF THE INVENTION

The present invention relates to a device for clearing obstructed soil pipes without splashing water from the sink or toilet bowl. The device comprises an elongate handle having a plunger member at the lower end thereof and an anti-splash shield having a central passage to receive the elongate handle, the shield having a curvilinear circumference and including expandable resilient means at the outer edge thereof for transforming the shield from a folded condition to an expanded condition whereby the outer edge of the shield can sealingly engage the inner surface of the sink or toilet bowl to prevent water from splashing as the plunger is operated.

It is an object of this invention to provide a plunger for clearing obstructed pipes having means for preventing water from splashing from a sink or toilet bowl when the plunger is operated.

Other objects and advantages of this invention will be apparent from the following detailed description made with reference to the accompanying drawings.

BRIEF DESCRIPTION OF THE DRAWINGS

FIG. 1 is a side elevational view of the device showing the foldable shield removably connected to an elongate handle;

FIG. 2 is a bottom view of the device;

FIG. 3 is a cross sectional view of the device operatively positioned within a toilet bowl; and FIG. 4 is a sectional view taken along the line 4—4 of FIG. 1.

DETAILED DESCRIPTION OF THE INVENTION

A preferred embodiment of the present invention is shown in FIG. 1. The device, indicated generally by the reference numeral 10, includes an elongate handle 12 having a plunger member 14 at the lower end thereof. The plunger member 14 can be pressfit or threadably secured to the elongate handle 12 in a conventional manner. As will be recognized by those skilled in the art, the plunger member 14 can include an annular flange 16 about the open end 18 to sealingly engage a working surface.

A circular or oval-shaped shield 20 having a central passage 22 for receiving the elongate handle 12 is positioned about the handle 12 over the plunger member 14. The shield 20 can include a plurality of radially extending accordion-like pleats 24 to allow folding the shield inwardly towards the elongate handle 12. As shown in FIG. 2, the pleats 24 extend radially from the central passage 22 to the outer edge 26 of the shield 20.

Moreover, the outer edge 26 of the shield 20 includes resilient means 28 in the form of an expandable band of steel or plastic, for example, to hold the shield 20 in an expanded condition against the inner surface of a toilet bowl 30 as shown in FIG. 3.

In a preferred embodiment, the resilient means 28 is molded within the outer edge 26 of the shield (which is formed of a flexible plastic or rubber and includes a passage 32 to receive the resilient means 28)—see FIG. 4. The ends of the resilient means 28 are slidably received by a locking collar 34 which allows the circumference of the shield 20 to be adjusted and the outer edge 26 to conform to the shape of the inner surface of the toilet bowl 30.

Specifically, the collar 34 functions like a buckle whereby one end 36 of resilient means 28 is secured to the collar and the other end 38 can be slidably received by one or more openings 40 in the side portions of the collar 34 to increase or decrease the circumference of the shield. A tab 42 at the end 38 prevents the resilient means 28 from passing through the opening 40 and being separated from the collar 34 when the resilient means is fully expanded.

In an alternative embodiment, both ends 36 and 38 of the resilient means 28 can include tabs 42 and can be slidably received by the openings 40 in the side portions of the collar 34.

It will be understood that the device 10 can also be used in a sink bowl whereby the outer edge 26 of the shield 20 engages the inner surface of the sink. The shield 20 can take any number of shapes. A circular or ovoid shield is preferred, although any design having a curvilinear circumference can be used provided the outer edge 26 sealingly engages the inner surface of the sink or toilet bowl.

The shield 20 includes a reinforced ring portion 44 defining the central passage 22 which frictionally, but slidably, engages the elongate handle 12 to hold the shield 20 in a given position on the handle. The ring portion 44 can comprise a member separate from the shield adapted to engage the elongate handle 12 and prevent downward movement of the shield relative to the handle. As can be seen from the drawings, the opening in the ring portion that engages the elongate handle is the central passage 22. By sliding the ring portion along the handle, the vertical distance between the plunger member 14 and the shield can be controlled.

Referring to FIG. 3, the device 10 is shown positioned within the toilet bowl 30. In operation, the toilet bowl is partially filled with fresh water, the plunger member 14 is secured over the lower outlet portion 46 of the bowl 30, and the shield 20 is moved upwardly along the elongate handle 12 until the shield, when expanded, sealingly engages the inner surface of the bowl 30 above the waterline near the upper rim 48.

As the elongate handle 12 is moved vertically or reciprocated, the plunger member 14 acts in the conventional manner to create a partial vacuum and agitate the water within the bowl and the soil pipe 50 thereby clearing the obstruction. If the downward thrust does not clear the stoppage by forcing the passage of air, the pulling action may dislodge the obstruction enough for the water to flush properly.

The shield 20 prevents water, agitated by the reciprocating action of the plunger, from splashing onto the floor about the toilet bowl. The advantages of this feature to health and sanitation are self-evident.

It will be understood that various changes and modifications can be made in the above-described embodiments of the invention without departing from the spirit thereof, particularly as defined in the following claims.

That which is claimed is:

1. In a device for engaging the inner surface of a sink or toilet bowl to clear an obstructed soil pipe including an elongate handle having a plunger member removably secured to the lower end thereof that sealingly engages the inner surface of the bowl, the improvement comprising a shield having a central passage to slidably engage the elongate handle and position the shield above the plunger member on the elongate handle, a curvilinear outer edge, a plurality of folds that extend radially from the central passage to the outer edge and resilient means along the outer edge for engaging the inner surface of the bowl to prevent water from splashing out of the bowl as the elongate handle is moved vertically to compress the plunger member against the inner surface of the bowl.

2. A device according to claim 1 wherein said shield includes a ring portion about the central passage for frictionally, but slidably, engaging the elongate handle.

3. A device according to claim 1 wherein said resilient means comprises an expandable band to hold the outer edge of the shield against the inner surface of the bowl as the elongate handle is moved vertically.

4. A device according to claim 1 including means for slidably receiving the ends of said resilient means to allow the circumference of said shield to be adjusted and the outer edge to conform to the shape of the inner surface of the bowl.

* * * * *